US010309752B1

(12) United States Patent
Britt

(10) Patent No.: US 10,309,752 B1
(45) Date of Patent: Jun. 4, 2019

(54) STABILIZING RECOIL LUG AND RAIL FOR RIFLE SCOPE MOUNTING AND METHOD OF USE

(71) Applicant: SARS Precision Machine, LLC, Pearl, MS (US)

(72) Inventor: Alton W. Britt, Brandon, MS (US)

( * ) Notice: Subject to any disclaimer, the term of this patent is extended or adjusted under 35 U.S.C. 154(b) by 0 days.

(21) Appl. No.: 16/186,453

(22) Filed: Nov. 9, 2018

Related U.S. Application Data

(63) Continuation-in-part of application No. 16/024,534, filed on Jun. 29, 2018.

(51) Int. Cl.
*F41G 11/00* (2006.01)

(52) U.S. Cl.
CPC ..... *F41G 11/002* (2013.01)

(58) Field of Classification Search
CPC ..... F41G 11/002–11/005; F41A 21/485; F41C 27/22
USPC ..... 42/124, 75.02, 75.03, 106
See application file for complete search history.

(56) References Cited

U.S. PATENT DOCUMENTS

| | | | | |
|---|---|---|---|---|
| 5,410,834 | A * | 5/1995 | Benton | F41A 21/482 42/75.02 |
| 8,230,633 | B1 * | 7/2012 | Sisk | F41C 23/06 42/75.01 |
| 9,285,178 | B2 * | 3/2016 | Sellars | F41A 21/485 |
| 2003/0140546 | A1 * | 7/2003 | Kay | F41G 1/033 42/133 |
| 2009/0077855 | A1 * | 3/2009 | Pritchett | F41G 11/003 42/90 |
| 2009/0277067 | A1 * | 11/2009 | Gregg | F41A 3/66 42/69.01 |
| 2010/0307042 | A1 * | 12/2010 | Jarboe | F41A 3/18 42/6 |
| 2015/0007476 | A1 * | 1/2015 | Dextraze | F41G 11/003 42/71.01 |

* cited by examiner

*Primary Examiner* — John Cooper
(74) *Attorney, Agent, or Firm* — Greenspoon Marder LLP; Justin McNaughton

(57) ABSTRACT

A device and method for stabilizing a rifle scope that employs a pocket cut in the bottom of a scope base (picatinny rail) that precisely mates with a key formed on the top of a recoil lug, such that when the scope base is attached to the rifle's action receiver and mated with the lug's key, the lug holds the barrel and the scope base locked in tandem so that they move exactly together during recoil events or any vibrations experienced by the rifle.

15 Claims, 17 Drawing Sheets

STABILIZING RECOIL LUG AND RAIL FOR RIFLE SCOPE MOUNTING AND METHOD OF USE

CROSS-REFERENCE TO RELATED APPLICATION

The present application is a Continuation in part of U.S. Utility patent application Ser. No. 16/024,534, filed on Jun. 29, 2018, the entirety of which is hereby incorporated by reference.

BACKGROUND OF THE INVENTION

The demands and expectations for precision long-range shooting have increased. As shooters increase the distances they are shooting, the caliber and recoil of the rifles required to accurately achieve those distances has increased; scopes are getting larger and rifles are getting more powerful. A problem with existing scope mounts is that while scopes are anchored to rifles using rails and/or scope rings, often the rails are attached to an action receiver by only a few small screws. These screws are often not sufficient to anchor a scope exactly in place after repeated shots and, as a result, the scope often shifts slightly or becomes loose. Additionally, scopes can come unseated or loose from a rifle when the rifle is stored in a vehicle or other area and subject to frequent vibration. When the scope comes loose, it requires the shooter to recalibrate the rifle before the rifle can reliably engage a distant target. In an emergency situation, such as a response by a SWAT team, a loose scope can mean the difference between the success and failure of the team.

While previous rails and lugs, such as American Rifle Company's Nucleus Bolt Action Receiver, Rail and Recoil lug, have included a guide channel carved into the bottom of a rail and a keyed lug that can guide a barrel into the same general position under a rail when the barrel is being attached to a receiver, these existing devices do not hold the rail in tandem with the barrel and the action receiver. In particular, these existing devices do not hold the rail in tandem with the action receiver in the forward and backward direction relative to the barrel's direction of firing. These existing devices also do not reinforce the screws holding the rail in place on the rifle against shear forces during recoil and jostling that may loosen or break the screws.

SUMMARY OF THE INVENTION

The present disclosure is a device and method for stabilizing a rifle scope that employs a pocket cut in the bottom of a scope base (picatinny rail) that precisely mates with a key formed on the top of a recoil lug, such that when the scope base is attached to the rifle's action receiver and mated with the lug's key, the lug holds the barrel and the scope base locked in tandem so that they move exactly together (i.e., forwards, backwards, and side to side) during recoil events or any vibrations experienced by the rifle.

BRIEF DESCRIPTION OF DRAWINGS

The accompanying drawings, which are incorporated in and form a part of this specification, illustrate embodiments of the disclosure and together with the description, serve to explain the principles of the invention.

DETAILED DESCRIPTION

Figure 1:
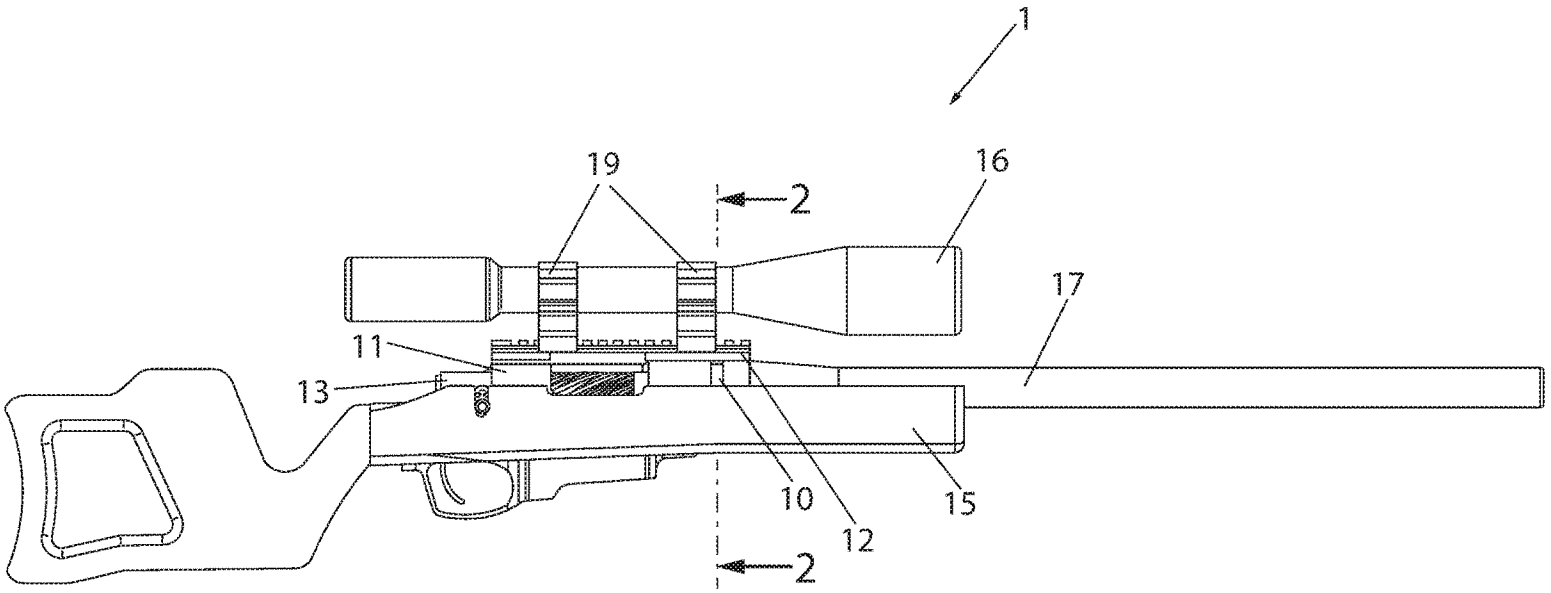
FIG. 1 is a right side elevational view of a stabilizing recoil lug installed on a rifle according to selected embodiments of the current disclosure.

Many aspects of the invention can be better understood with the references made to the drawings. The components are not necessarily to scale. Instead, emphasis is placed upon clearly illustrating the components of the present disclosure. Moreover, like reference numerals designate corresponding parts through the several views in the figures.

The stabilizing recoil lug comprises two main components: a Mil-spec 1913 rail 12 (i.e., a picatinny rail, scope base, cross-slotted base or rail, 1913 rail, top receiver rail, or receiver rail) and a stabilizing recoil lug 10 (i.e., recoil lug, lug, washer, spacer, recoil ring, ring spacer, ring washer, barrel spacer, receiver spacer, recoil absorption ring, etc.). As shown in FIG. 1, in one embodiment, the stabilizing recoil lug 10 is positioned in line between the barrel 17 and the action receiver 11. In one embodiment, the scope rings 19 attach a scope 16 (i.e., reticle, glass, rifle scope, etc.) to a rail 12, the rail 12 is attached to the action receiver 11, and the action receiver sits in a stock 15 (i.e., buttstock, chassis, etc.). In yet other embodiments, the rail can be used to support night vision or other sighting devices. In one embodiment, the stabilizing recoil lug 10 forms a ring having an external diameter that is the same as the external diameter of the receiver face. In one embodiment, the stabilizing recoil lug 10 fits over the outside threading of the end of the barrel 17 so that it does not interfere with the screwthreads on the end of the barrel 17 when the barrel 17 is screwed into the action receiver 11. In another embodiment, the inner circle of the stabilizing recoil lug 10 can be threaded to receive the threading on the barrel 17 so that the lug 10 can be screwed directly onto the barrel 17. In one embodiment, the stabilizing recoil lug 10 has the same external diameter as the external diameter of the action receiver 11, but in other embodiments the stabilizing recoil lug 10 can have a smaller or larger diameter than the external diameter of the action receiver 11.

In one embodiment, the stabilizing recoil lug 10 is made from aluminum, aluminum alloy (e.g., 6061, 7075, or 7068), titanium, steel, steel alloy, stainless steel (e.g., 300, 303, 304, or 400 grade), or a composite. In one embodiment, a resilient material is used for the lug that will compress to absorb recoil and then expand to its original size.

Figure 2:
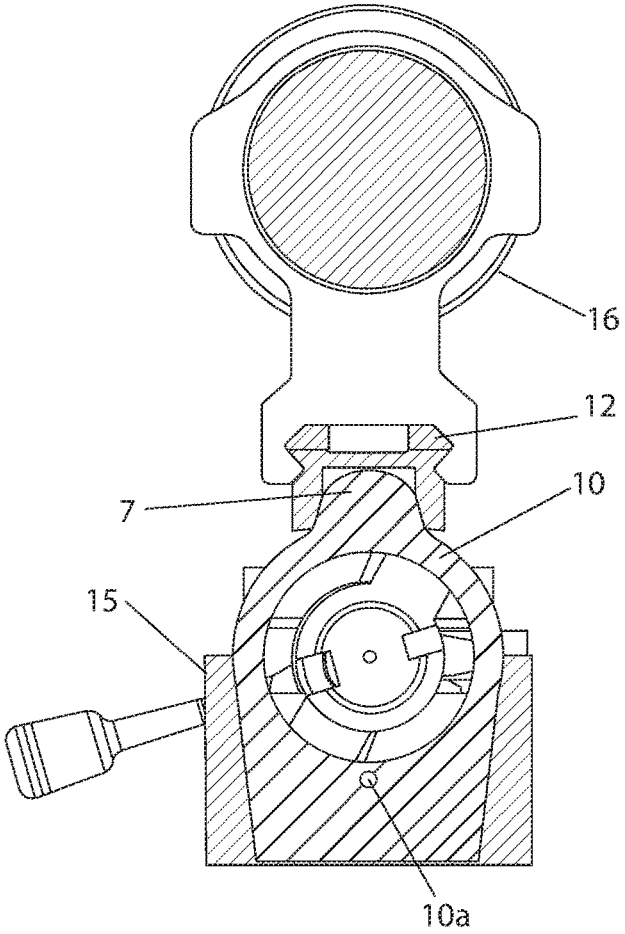
FIG. 2 is a rear cutaway view, of the location designated in FIG. 1, of a stabilizing recoil lug fitted into a pocket of a rail according to selected embodiments of the current disclosure.

As shown in exemplary FIG. 2, a cutaway view of the location designated in FIG. 1, the stabilizing recoil lug 10 has a bottom with a pin hole 10*a* and a top with a key 7 (i.e., pin, shaft, fastener, tab, nub, protrusion, protuberance, member, shaft, rod, mandrel, ball, cone, woodruff key, etc.). The barrel 17 and the action receiver 11 each have a dorsal surface facing the scope 16 and a ventral surface facing the stock 15. The key 7 on the dorsal end of the stabilizing recoil lug 10 extends above the dorsal surface of the barrel 17 and the action receiver 11, and it fits into a pocket (i.e., a keyseat, keyway, slot, groove, opening, detent, collar, collet, etc.) formed out of the bottom of the rail 12.

Figure 3:
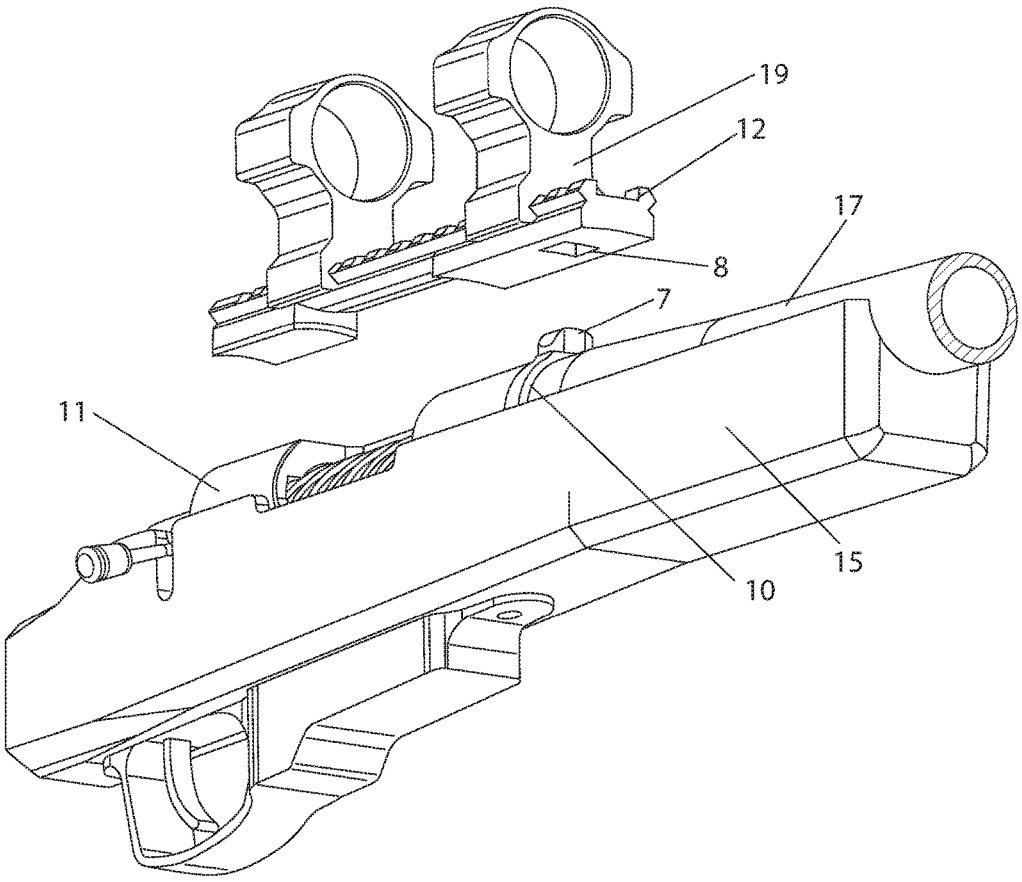
FIG. 3 is a partially exploded perspective view of the bottom, right side of a pocket in the bottom of a rail and a matching key on a stabilizing recoil lug that is attached to a barrel of a rifle according to selected embodiments of the current disclosure.

As shown in exemplary FIG. 3, the rail 12 has a top and a bottom, and a pocket 8 in the bottom that is shaped to receive the key 7 of the stabilizing recoil lug 10. In one embodiment, the stabilizing recoil lug 10 has a greater external diameter than the external diameter of the barrel 17 and equal to the external diameter of the action receiver 11. In other embodiments, the diameter of the stabilizing recoil lug 10 relative to the action receiver 11 and the barrel 17 vary. In one embodiment, the stabilizing recoil lug 10 is the same external diameter as the action receiver so that it fits a standard stock 15 for that receiver without any modifications. In one embodiment, the rings 19 (i.e., scope rings, scope base rings, clamps, scope stabilizers, etc.) are separate from the scope base 12, but in other embodiments, the rings 19 and the scope base 12 are integrally formed as a single piece. As an integral unit, the rings 19 are less adjustable, but also less prone to movement. In one embodiment, the rail 12 is a standard MIL-spec 1913 Rail. In other embodiments, the rail is customized to fit a particular scope and action receiver. For example, an integrally formed rail and rings would not need to have the same pattern on top of the rail and would not need a pocket and key. In one example, the disclosed device fits directly to dove tail mounts on the action receiver 11. In yet another embodiment, the key 7 and stabilizing recoil lug 10 can be used with a two piece rail (not shown) by having a pocket in one of the rails that connects with the key. As shown in FIG. 3, in one embodiment the pocket matches the forward facing and backward facing sides of the key 7, thus preventing the rail from moving forward or backward relative to the lug. In one embodiment, as shown in FIG. 3, the pocket does not exactly match the key, but wall of the pocket touches a side of the key to prevent horizontal movement in any direction. As shown in FIG. 3, the key 7 fits the pocket walls with an interference fit on at least three sides (i.e., left side, right side, and back side). As shown in FIG. 3, the key 7 fits the pocket in an interference fits on at least two sides (i.e., front and back side). As the majority of the recoil, when a rifle is fired, is in the rearward direction, the back or rear side of the key 7 should fit snuggly against rear wall of the pocket to prevent the rail from shifting. In other applications where the rifle is jostled in many directions, the side of key 7 should fit snugly against a pocket wall in every direction along a horizontal plane to hold the rail in place. As shown in FIG. 3, in one embodiment, the pocket has a wall or walls on all sides or has multiple walls that connect to form a geometric shape. Described another way, when the key 7 is in the pocket and the rail is screwed to the action receiver, the recoil lug 10 pins the rail 12 to the barrel and the action receiver so that the rail 12 cannot move in any horizontal direction relative to the recoil lug, barrel and action receiver.

In one embodiment, the key 7 on the stabilizing recoil lug 10 can be shaped as a square, rectangle, triangle, circle, pyramid, oval, or another geometric shape; provided that the pocket 8 is shaped to receive it. In one embodiment, the sides of the key 7 can be tapered or vertical; provided that the pocket 8 is shaped to receive it. In one embodiment, the key 7 fits the pocket 8 tightly, pushed on forced fit, or interference fit, but not hammer tight. In one embodiment, the rim of the uncoated pocket 8 is about 0.0002 inches wider and 0.0002 inches longer than the key 7, leaving 0.0001 inches of clearance on each side. In one embodiment, when the key 7 is coated (i.e., with KG Coating, Cerakoting, etc.) the key 7 will be between about 0.0001 wider and thicker than the pocket 8. In one embodiment, the ratio of dimensions around the coated key 7 to the dimensions around the pocket 8 ranges between about 0.1 to 0.9990 inches and 0.1 to 0.1005 inches. If the key 7 is more than 0.0005 inches smaller in either width or thickness than the pocket 8, then the pocket 8 will not properly hold the key 7, lug 10, and rail 12 in place. If the key 7 is more than 0.0002 inches wider or thicker than the pocket 8, then it will not fit into the pocket 8 properly. If the key 7 is uncoated, then the key 7 should be about 0.0005 thinner and narrower than the pocket 8. In one embodiment, the key 7 is between about 0.0005 to 0.0001 inches narrower and thinner than the pocket 8. The coating provides some flexibility and fills in the gaps, which allows the key 7 to fit the pocket 8 tightly. In one embodiment, when the key 7 is coated, it will connect to the pocket 8 with an "interference fit." In one embodiment, if an uncoated key 7 is used, then it will be sized appropriately to connect to the pocket 8 with an "interference fit." In many embodiments, the pocket 8 is uncoated. In some embodiments, the pocket 8 may also be coated or coated instead of the key 7.

Figure 4:
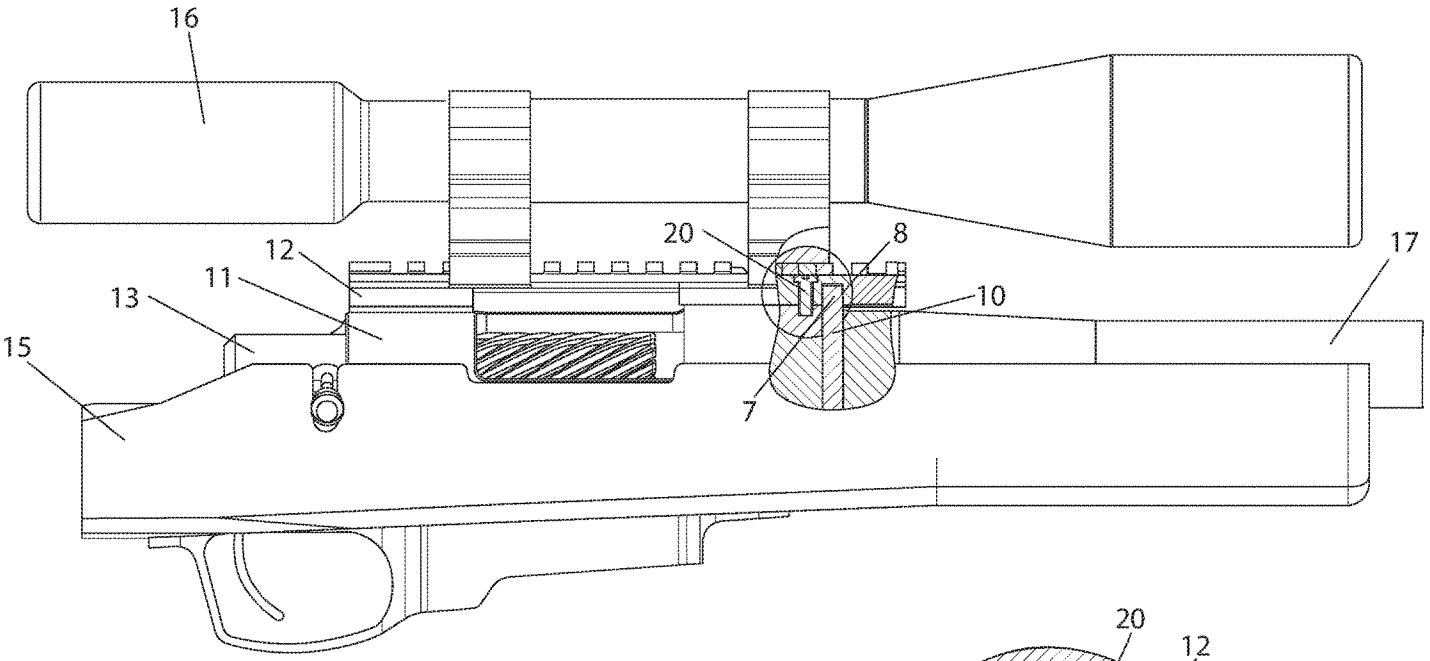
FIG. 4 is a side elevational cutaway view of a stabilizing recoil lug installed on a rifle (showing only a section of the rifle), with the lug's key inserted into a pocket in the bottom of a rail according to selected embodiments of the current disclosure.
Figure 5:
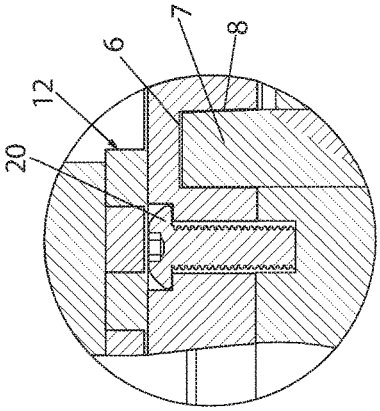
FIG. 5 is a close up of an embodiment of the stabilizing recoil lug's key inserted into a pocket of a rail from FIG. 4, showing detail of the lug, key, and pocket according to selected embodiments of the current disclosure.

As shown in FIG. 4, when the rail 12 is seated on the action receiver 11, the bottom of the rail 12 fits the dorsal surface of the action receiver 11. In one embodiment, screws 20 hold the rail 12 against the action receiver 11. In one embodiment, as shown in the cutaway portion of FIG. 4, the stabilizing recoil lug 10 fits between the barrel 17, the action receiver 11, and the rail 12 without leaving any gaps that could lead to instability. As shown in FIG. 5, the screws 20 are separated or apart from the stabilizing recoil lug 10. In one embodiment, the key 7 fits snugly into the pocket 8. The key 7 does not interfere with the attachment screws 20.

In one embodiment, the key 7 can be permanently attached to the pocket 8, for example, it can be welded, fused, soldered, screwed, attached with Loctite or an adhesive. In such an embodiment, the position of the rail 12 relative to the lug 10 is reinforced.

Figure 6:
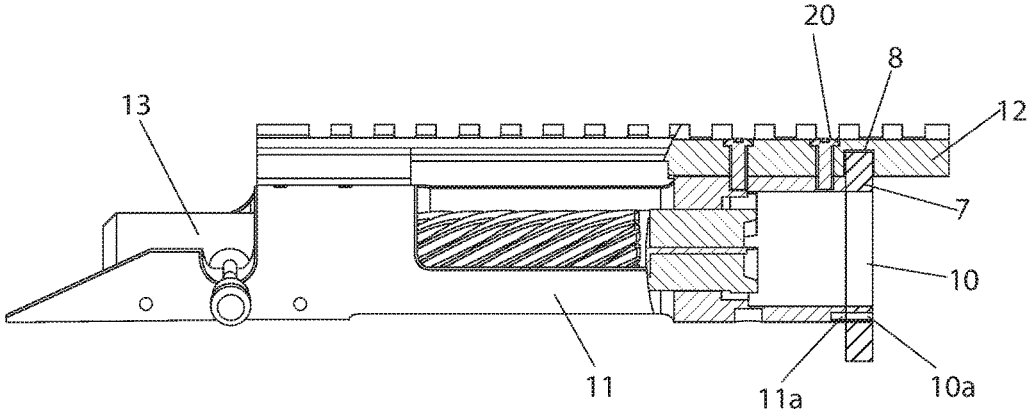
FIG. 6 is a side elevational cutaway view of an action receiver with a stabilizing recoil lug next to the action receiver and the key inserted into a pocket of a rail according to selected embodiments of the current disclosure.

As shown in FIG. 6, in one embodiment, the pocket 8 is slightly deeper than the key 7 so that the top of the key 7 does not touch the top of the pocket when the rail 12 is attached to the action receiver 11. In one embodiment, there is no gap between the sidewalls of the pocket 8 and the sidewalls of the key 7. In one embodiment, the pinhole 10*a* in the stabilizing recoil lug 10 aligns with a pinhole 11*a* in the action receiver 11. The pinhole 11*a* in the action receiver is present on most action receivers and the pinhole 10*a* in the stabilizing recoil lug 10 can match the diameter of the pinhole for a particular action receiver 11. In one embodiment, the diameter of the stabilizing recoil lug 10 is the same as the diameter of the action receiver 11 at the point where the action receiver 11 touches the stabilizing recoil lug 10.

In one embodiment, the key 7 is rectangular shaped, measuring 0.250 inches high, 0.240 inches thick, and 0.480 inches wide, and the pocket 8 is 0.260 inches high (deep), 0.2402 inches thick (long), and 0.4802 inches wide.

In one embodiment, the device comprises a lug configured to sit in line between a barrel and an action receiver, said lug having a top and a bottom, and the action receiver having a dorsal surface, the top of the lug further comprising a key; and a rail configured to attach to the dorsal surface of the action receiver, the rail having a bottom, and the bottom of the rail further comprising a pocket to receive the key. When the key is in the pocket, the key holds the rail in tandem (i.e., held in conjunction with or conjoined) with the lug and both the rail and the lug move together with the barrel and action receiver. Explained another way, when the key is in the pocket, connecting the rail to the lug, the rail recoils in tandem with the lug, and because the lug is attached to the action receiver, the rail also recoils in tandem with the action receiver. Said yet another way, the key and the pocket reinforce the connection between the rail (an mounted scope) and the action receiver to strengthen and reinforce the screws holding the rail to the action receiver against shear forces during recoil and jostling of a firearm and in particular powerful shear forces rearwards during recoil. As the rail is traditionally held to the action receiver using screws, the majority of the shear forces acting on the screws is along a single horizontal plane at the connection point between the rail and the barrel and the action receiver. The device reinforces that connection to provide an additional point of strength to prevent any movement of the rail along that horizontal plane, relative to the lug. The lug prevents any movement relative to the barrel and action receiver so that the rail cannot move independently in any horizontal direction from the barrel and the action receiver. In one embodiment, the device further comprises a key having a top and a pocket having a ceiling, the key being shorter than the pocket, such that when the key is in the pocket there is a gap between the top of the key and the ceiling of the pocket. The device also has a pocket having at least three walls and a key having at least three sides, wherein when the key is in the pocket, each one of the at least three sides of the key touches at least one of the at least three walls of the pocket. As shown in FIG. 3, one embodiment of the key has a single, continuous side that forms a circle, oval, stadium or other shaped key without corners around the circumference of the key. In one embodiment, the device further comprises a pinhole in the lug, the pinhole corresponding to a pinhole of about the same size on an action receiver, wherein the lug can be pinned to the receiver by inserting a pin through both the pinhole on the lug and the pinhole on the action receiver.

In one embodiment, the device further comprises an integrally formed rail and lug, the rail omitting the pocket and the lug omitting the key, wherein the lug and rail are conjoined, molded, or printed (e.g., 3D printed) as a single piece. In one embodiment, the lug is a separate piece from the rail, and the sides of the key are permanently attached to the walls of the pocket.

In another embodiment, the stabilizing recoil lug comprises a washer configured to sit between a barrel and an action receiver, said washer having a protrusion on at least one side; the protrusion configured to fit into a pocket on the bottom of a picatinny rail; wherein when the protrusion is in the pocket, the key holds the rail in tandem with the washer and both the rail and the washer move together with the barrel and action receiver. In one embodiment, the lug further comprises a protrusion having a top and a pocket having a ceiling, the protrusion being shorter than the pocket, such that when the protrusion is in the pocket there is a gap between the top of the protrusion and the ceiling of the pocket. In one embodiment, the device of the current disclosure further comprises a pocket having at least three walls and a protrusion having at least three sides, wherein when the protrusion is in the pocket, each one of the at least three sides of the protrusion touches at least one of the at least three walls of the pocket. In one embodiment, the protrusion has a single, continuous side that forms a circle, oval or other curved shape (i.e., a rounded rectangle, stadium, etc.) around the circumference of the key. In one embodiment, each key side matches a pocket wall, and every pocket wall matches a key side. In one embodiment, the sides of the protrusion fit the walls of the pocket with an interference fit, and more particularly, each side of the protrusion fits a wall of the pocket with an interference fit.

In yet another embodiment, the device comprises a rail for attaching a scope to a rifle, the device having a Mil-spec 1913 rail, with a top and a bottom, the bottom of the rail further comprising a keyseat. The keyseat having a geometric shape to receive a matching key on a recoil lug. The rail can be a retrofit of an existing rail to fit the key on a recoil lug. When the rail is seated on an action receiver and a lug with a matching key is positioned between the action receiver and a barrel, the matching key fits into the keyseat. More specifically, in one embodiment, each side of the key has a shape that fits a corresponding wall of the keyseat, so that when the key is inserted in the keyseat, every side has a matching wall. In one embodiment, the device includes a keyseat having at least three sides and a rail having two ends, the keyseat located off center toward one end of the rail.

In one embodiment, the stabilizing recoil lug 10 can be pinned to the action receiver 11 through pinholes 10*a* and 11*a*. In another embodiment, the stabilizing recoil lug 10 can be pinned to the action receiver 11 using pinholes on the sides or top of the stabilizing recoil lug 10; provided that the action receiver 11 has a pinhole in the same location to receive a pin. In one embodiment, each pinhole is about 0.093 inches in diameter. In another embodiment, the stabilizing recoil lug 10 can be permanently attached to the action receiver 11, for example, it can be welded, fused, soldered, screwed, or attached using Loctite or an adhesive. Alternatively, the stabilizing recoil lug 10 can be integral to the receiver.

Figure 7:
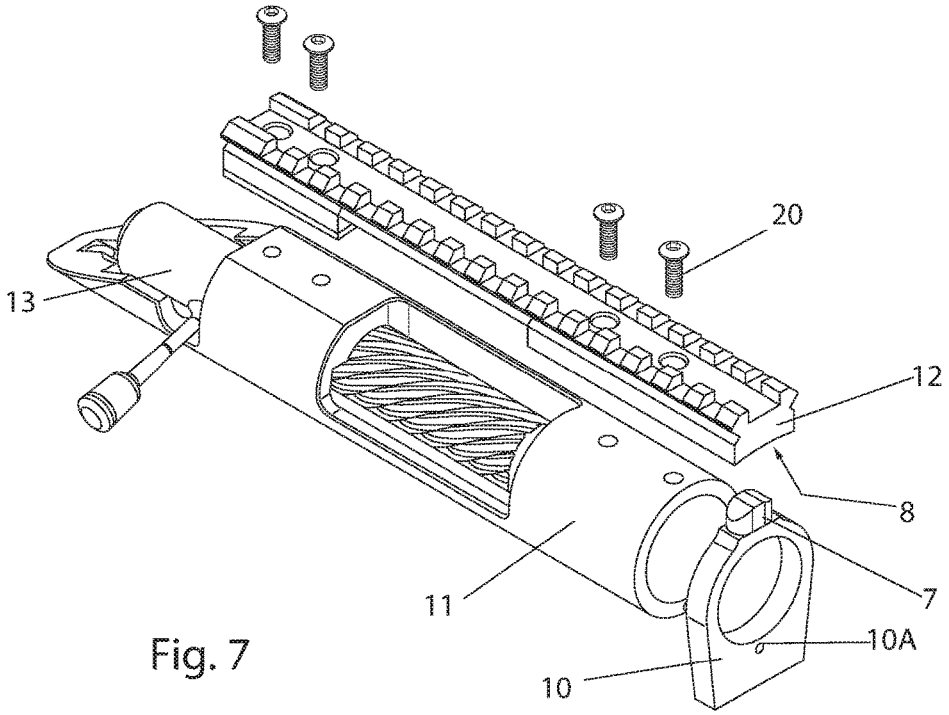
FIG. 7 is an exploded top, side perspective of an action receiver, a stabilizing recoil lug and a rail according to selected embodiments of the current disclosure.
Figure 8:
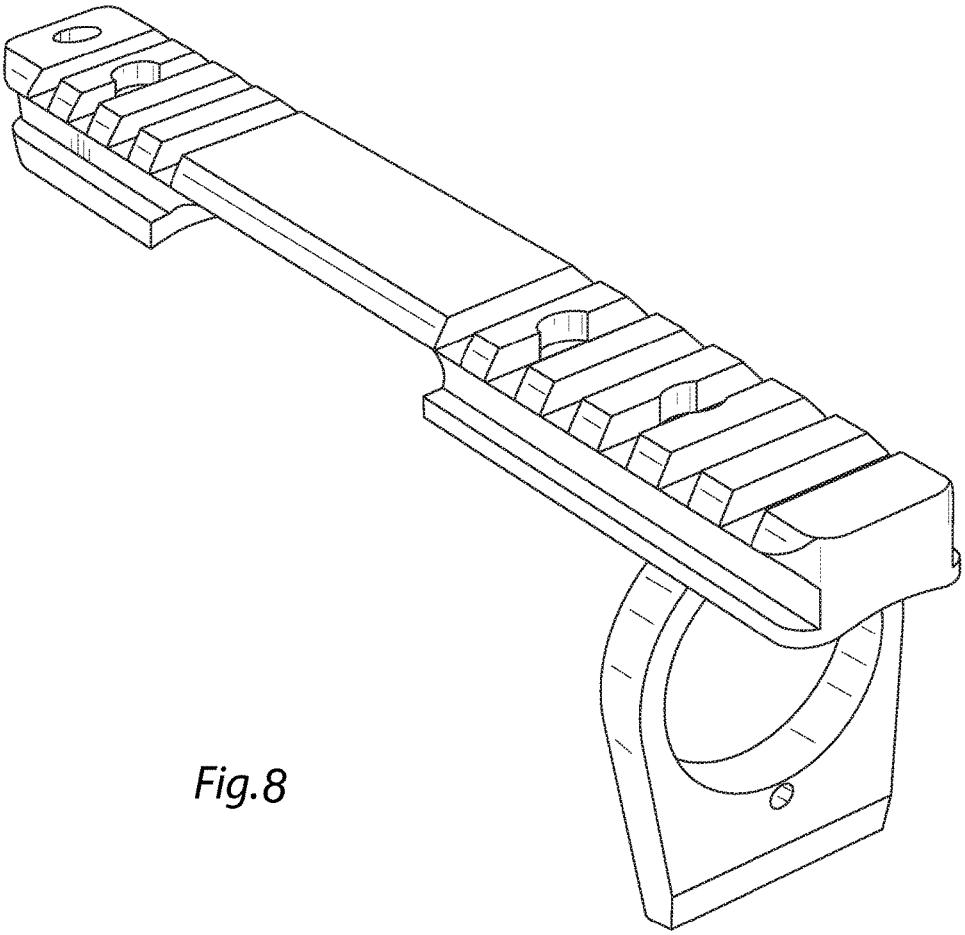
FIG. 8. is a top, front perspective view of a stabilizing recoil lug and rail according to selected embodiments of the current disclosure.
Figure 9:
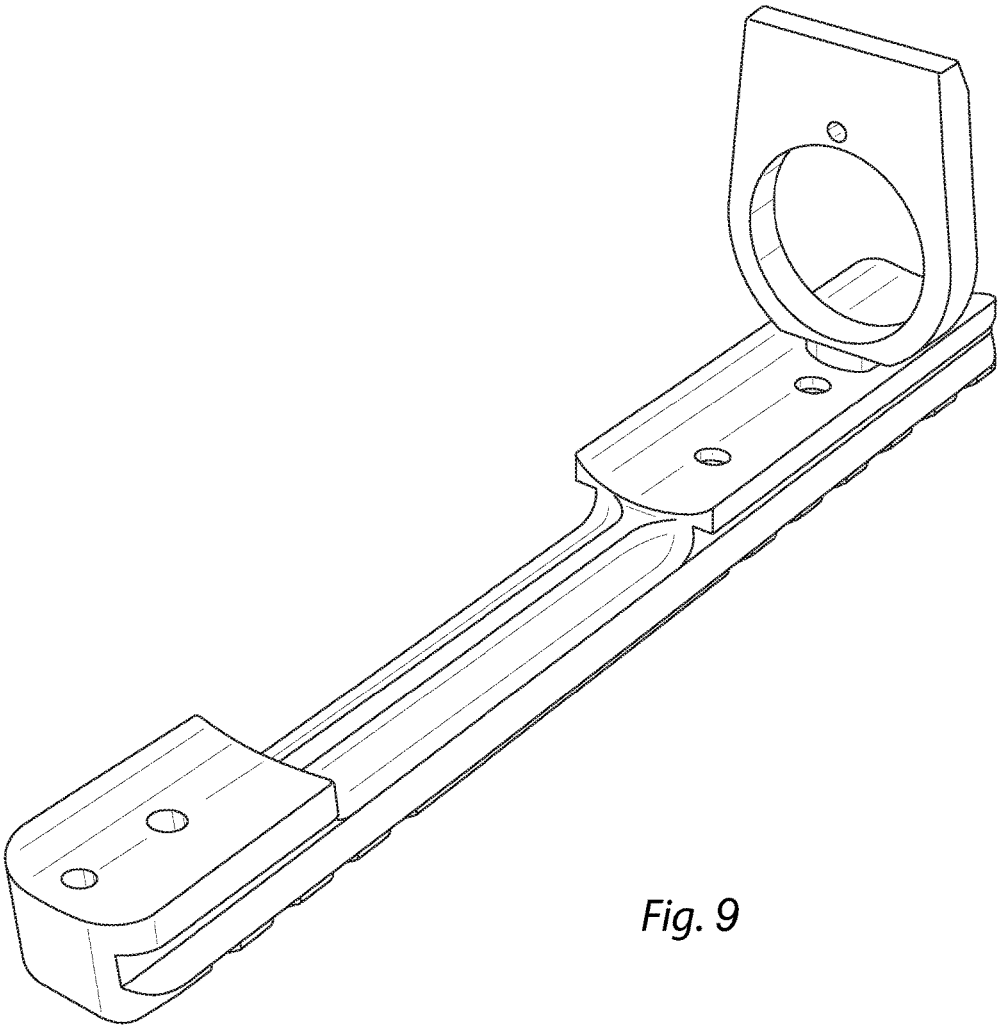
FIG. 9 is a bottom, rear perspective view of a stabilizing recoil lug and rail according to selected embodiments of the current disclosure, showing the recoil lug connected to the rail.
Figure 10:
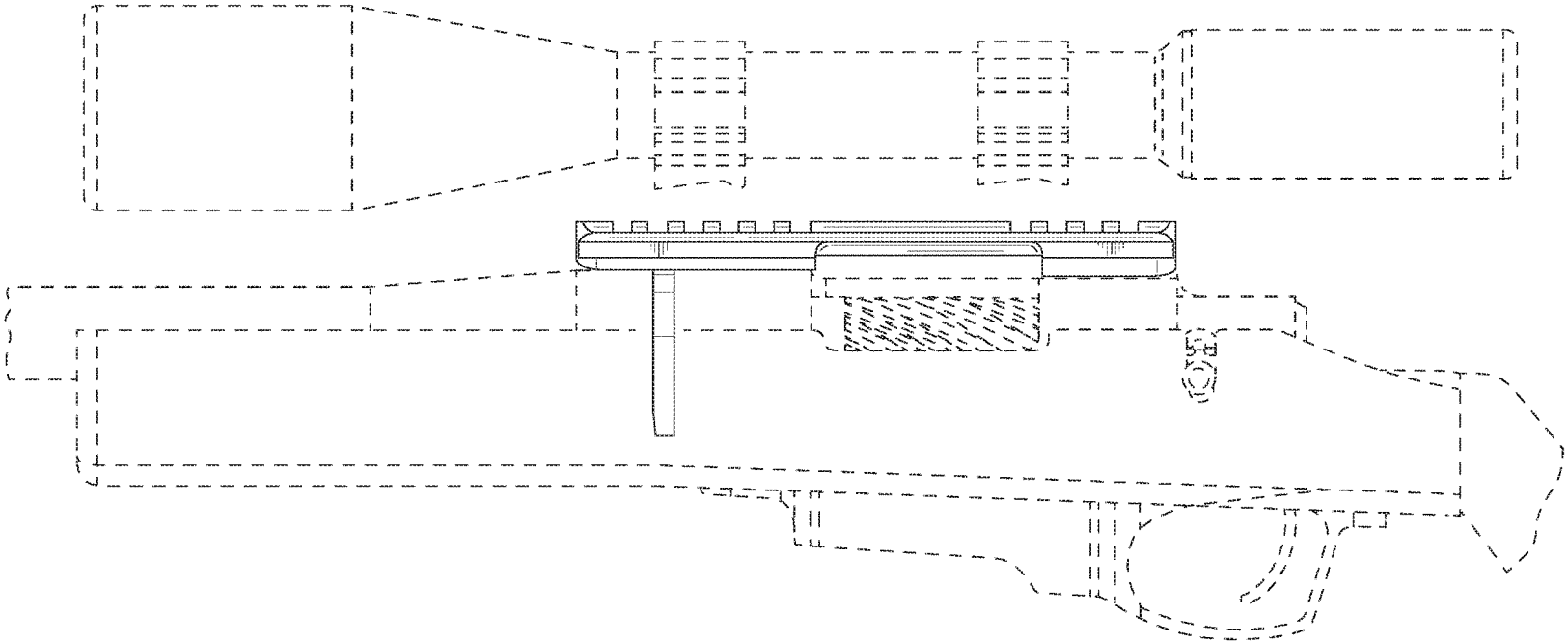
FIG. 10 is a left side elevational view of a stabilizing recoil lug and rail according to selected embodiments of the current disclosure, showing the recoil lug and rail installed on a rifle.
Figure 11:
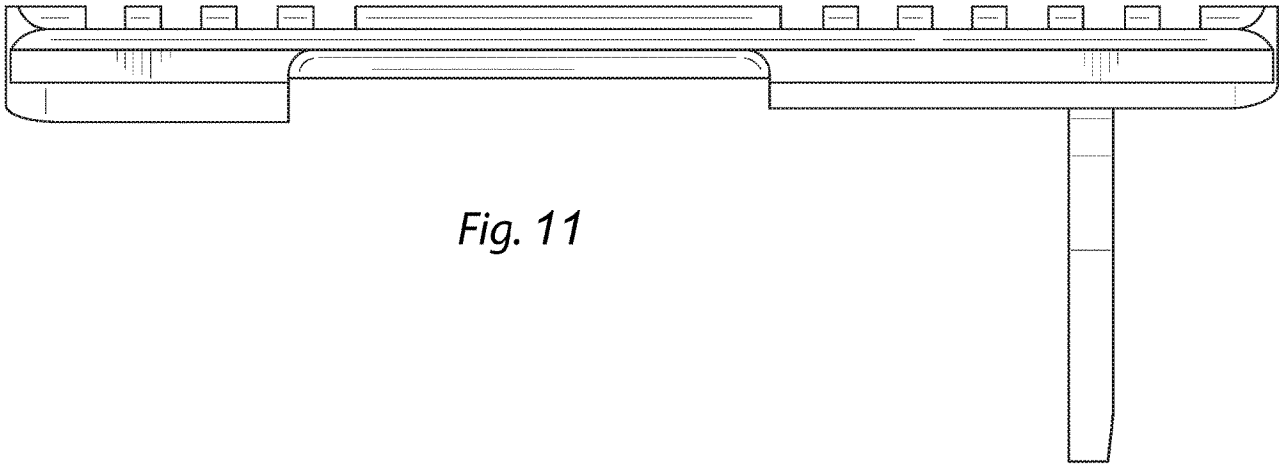
FIG. 11 is a right side elevational view of a stabilizing recoil lug and rail according to selected embodiments of the current disclosure, showing the recoil lug connected to the rail.
Figure 12:
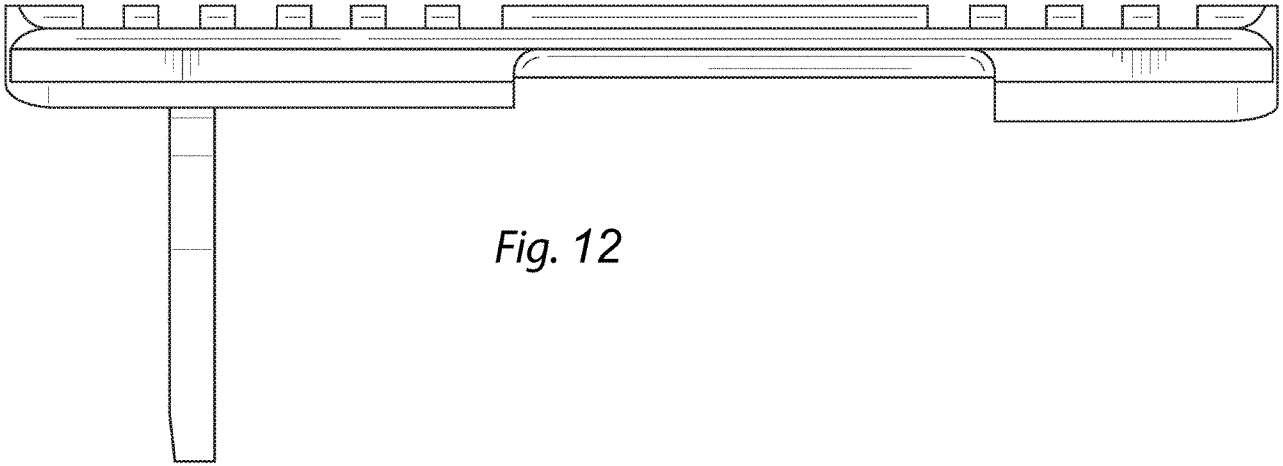
FIG. 12 is a left side elevational view of a stabilizing recoil lug and rail according to selected embodiments of the current disclosure, showing the recoil lug connected to the rail.
Figure 13:
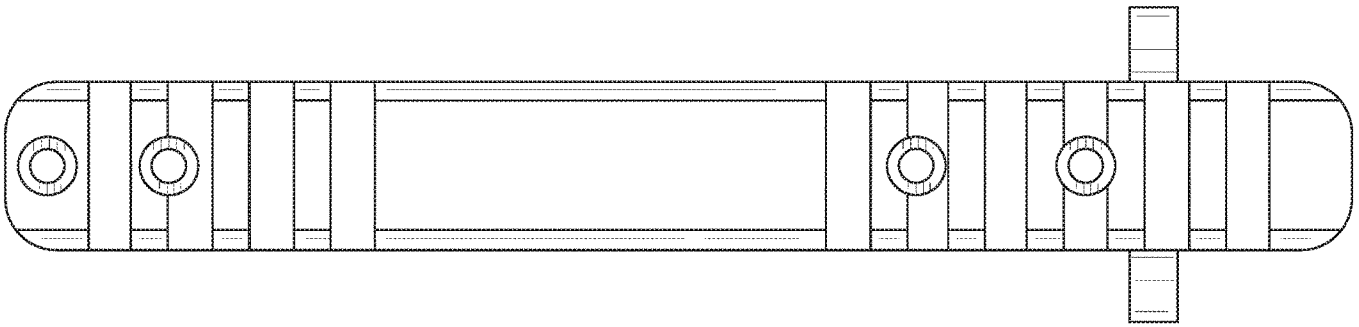
FIG. 13 is a top plan view of a stabilizing recoil lug and rail according to selected embodiments of the current disclosure, showing the rail sitting on the recoil lug.
Figure 14:
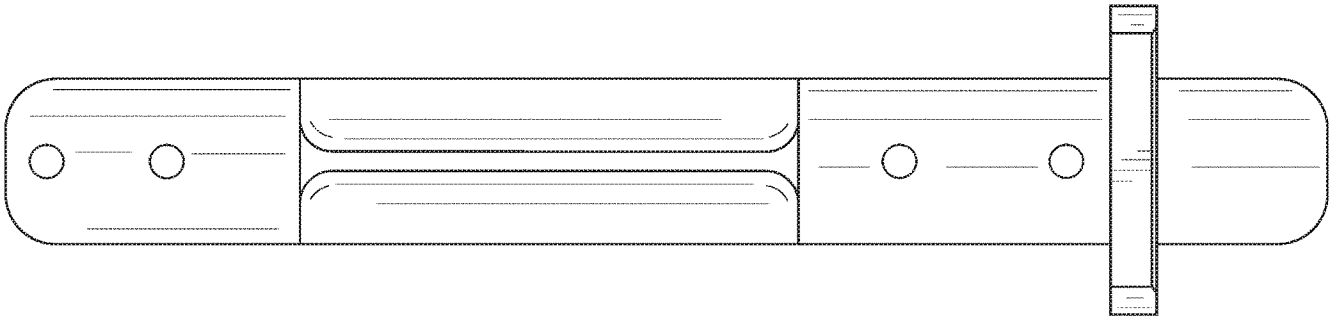
FIG. 14 is a bottom plan view of a stabilizing recoil lug and rail according to selected embodiments of the current disclosure, showing the recoil lug connected to the rail.
Figure 15:
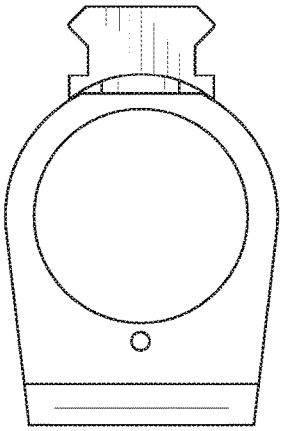
FIG. 15 is a front plan view of a stabilizing recoil lug and rail according to selected embodiments of the current disclosure, showing the rail sitting on the recoil lug.
Figure 16:
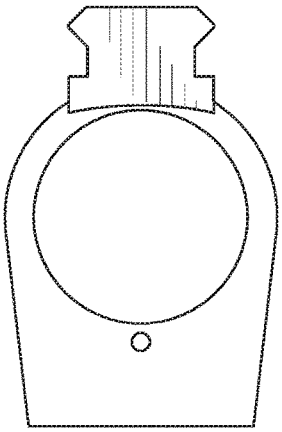
FIG. 16 is a rear plan view of a stabilizing recoil lug and rail according to selected embodiments of the current disclosure, showing the rail sitting on the recoil lug.
Figure 17:
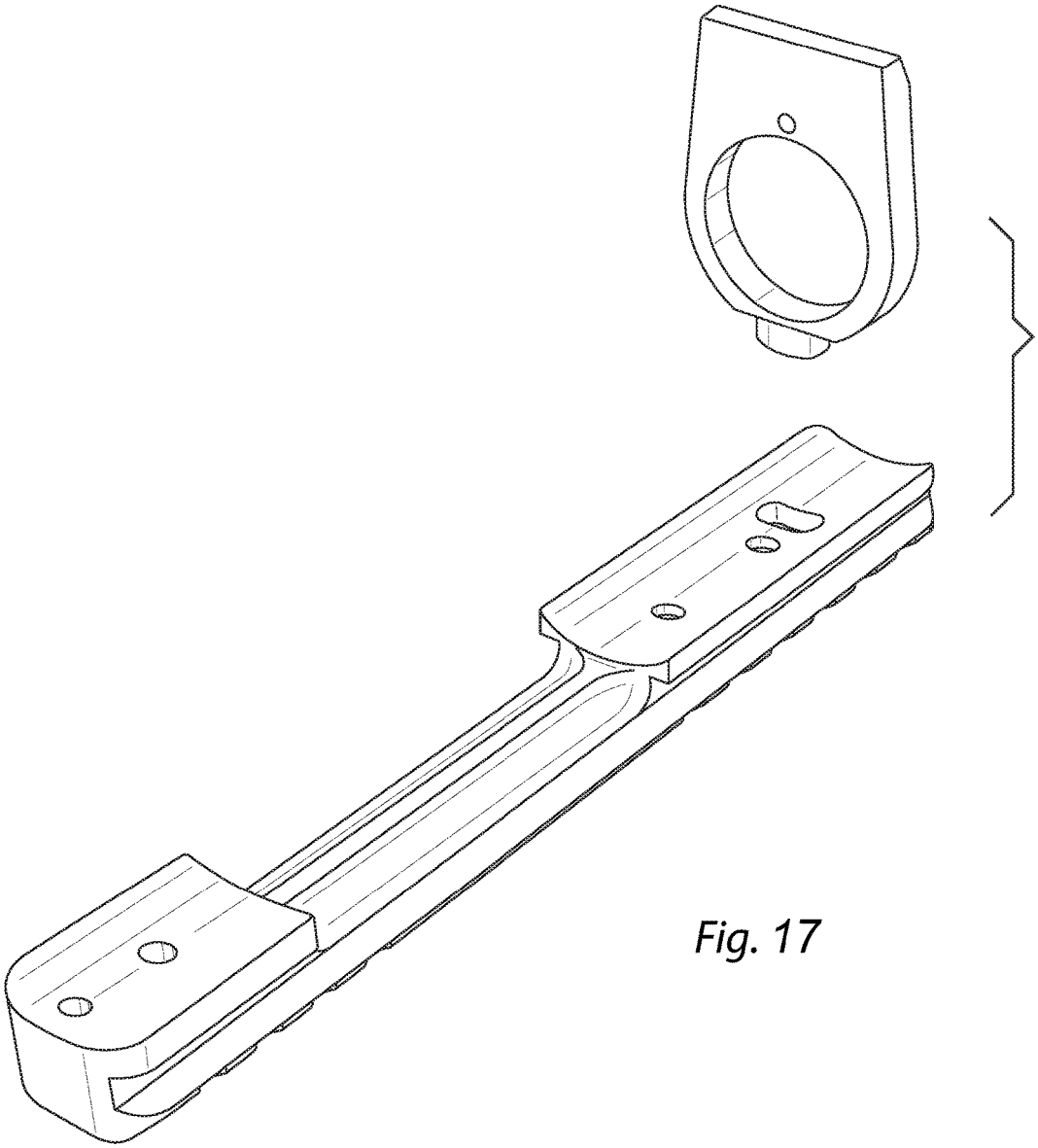
FIG. 17 is an exploded bottom, rear perspective view of a stabilizing recoil lug and rail according to selected embodiments of the current disclosure, showing the recoil lug separated from the rail.
Figure 18:
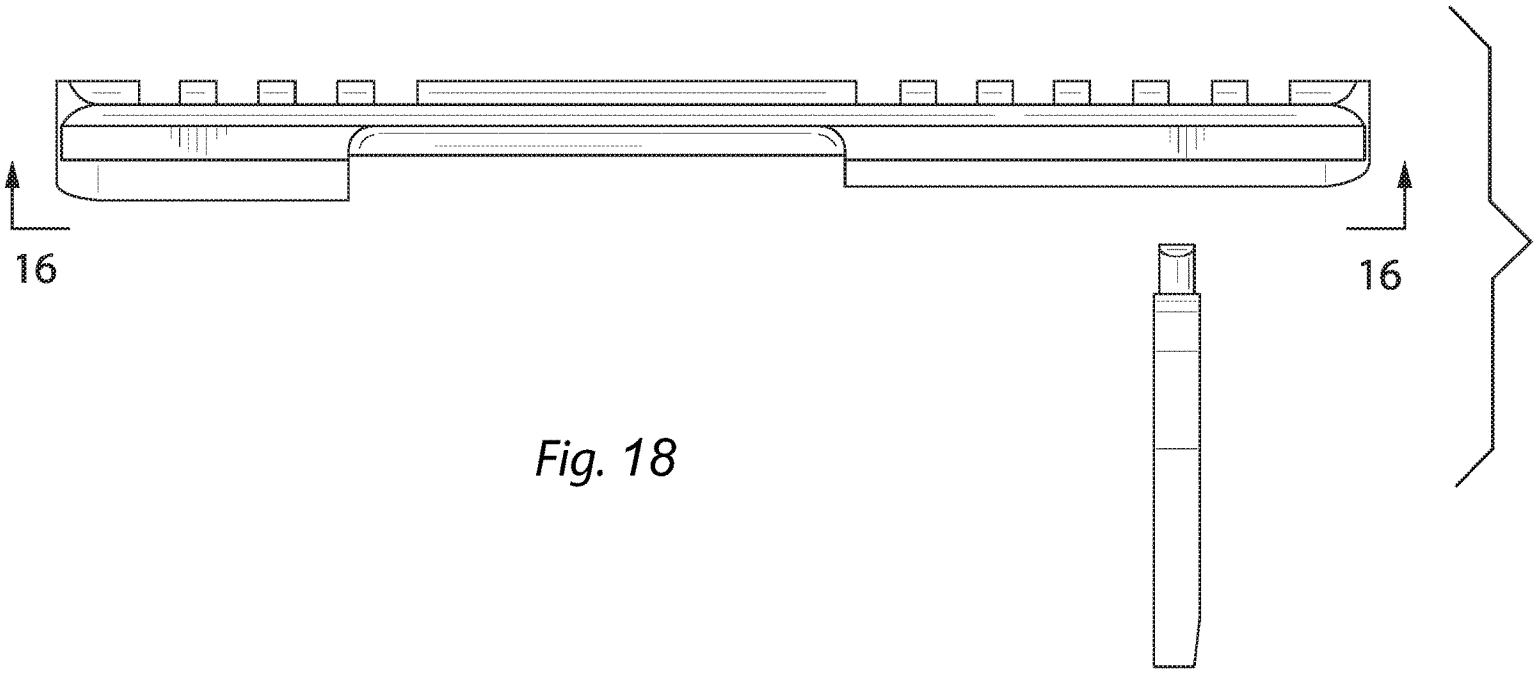
FIG. 18 is a right side exploded elevational view of a stabilizing recoil lug and rail according to selected embodiments of the current disclosure, showing the recoil lug separated from the rail.
Figure 19:
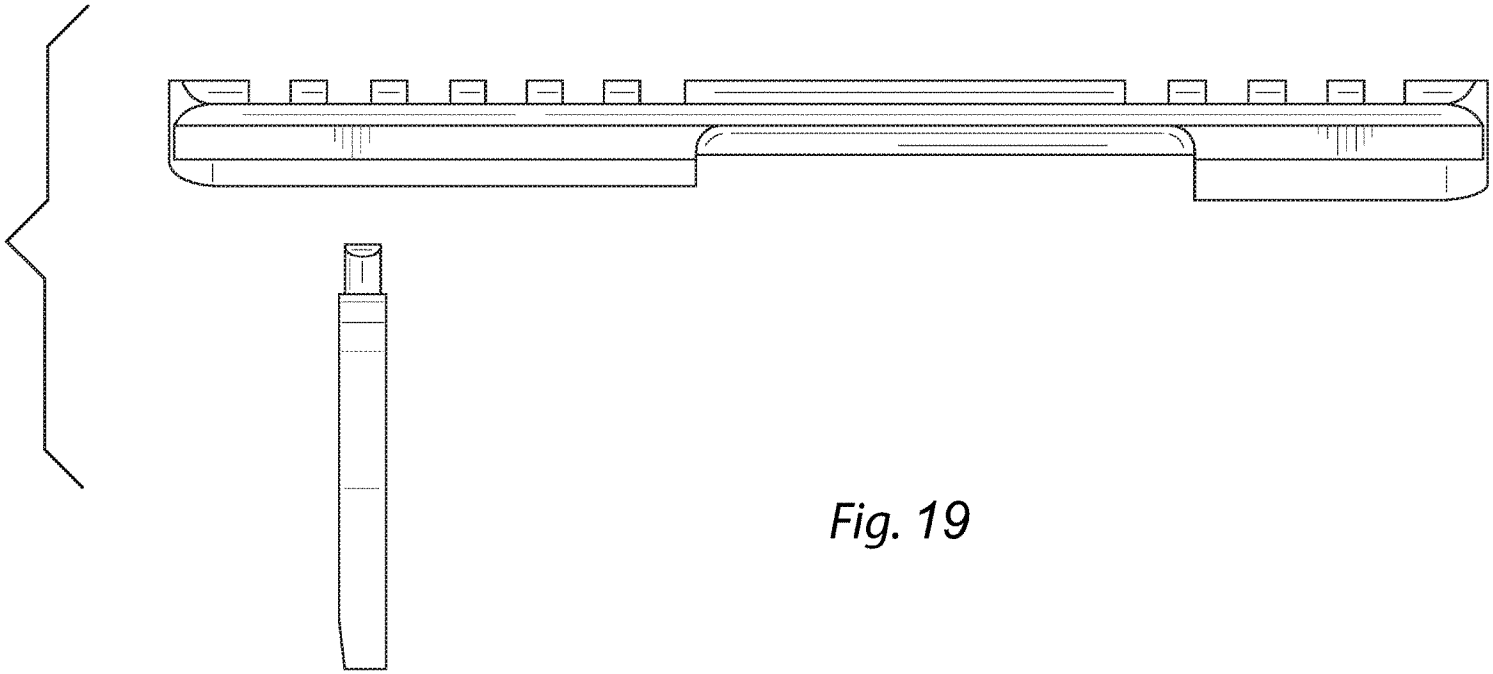
FIG. 19 is a left side exploded elevational view of a stabilizing recoil lug and rail according to selected embodiments of the current disclosure, showing the recoil lug separated from the rail.
Figure 20:
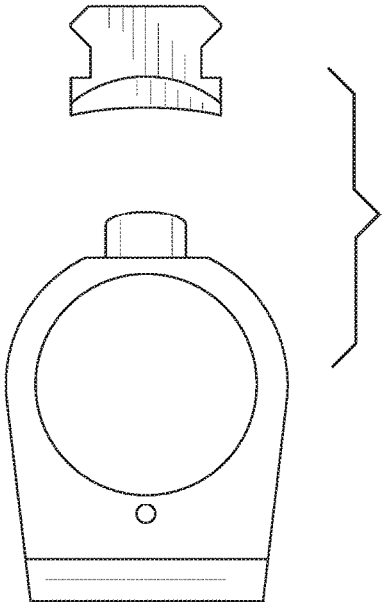
FIG. 20 is a front exploded elevational view of a stabilizing recoil lug and rail according to selected embodiments of the current disclosure, showing the recoil lug separated from the rail.
Figure 21:
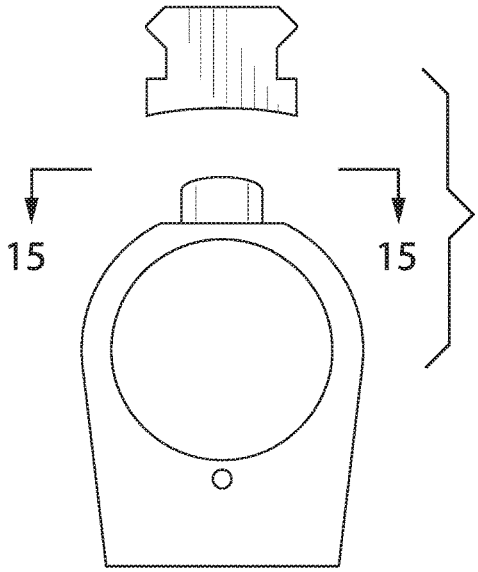
FIG. 21 is a rear exploded elevational view of a stabilizing recoil lug and rail according to selected embodiments of the current disclosure, showing the recoil lug separated from the rail.
Figure 22:
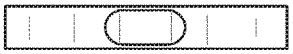
FIG. 22 is a top plan view of a stabilizing recoil lug according to selected embodiments of the current disclosure without the rail.
Figure 23:
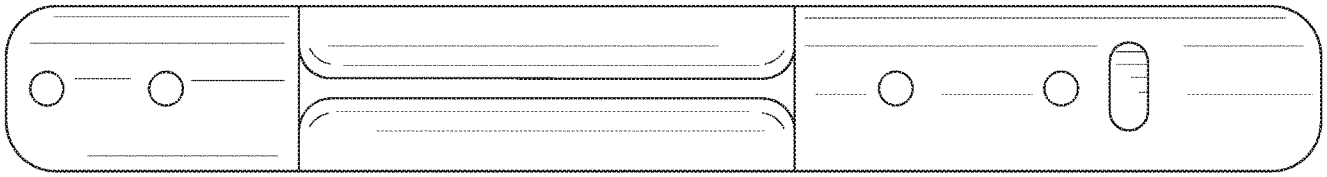
FIG. 23 is a bottom plan view of a rail according to selected embodiments of the current disclosure without the stabilizing recoil lug.
Figure 24:
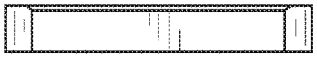
FIG. 24 is a bottom plan view of a stabilizing recoil lug according to selected embodiments of the current disclosure without the rail.

As shown in FIG. 7, in one embodiment, the rail 12 connects to the action receiver with four screws 20. In another embodiment, the rail 12 connects with two screws 20. In yet another embodiment, the rail 12 connects with six screws. In one embodiment, the screws 20 are inset in the top of the rail 12 so that they are flush and will not interfere with the rings 19. In one embodiment, as shown in FIG. 7, the key 7 is rectangular with a radius edge (i.e., a rounded rectangle or a stadium) and fits into a matching shaped pocket. In one embodiment, the key 7 is triangular and fits into a matching pocket 8.

In additional embodiments, the rail 12 is a minute of angle (MOA) rail that roughly forms a triangle having a base that fits the action receiver 11 with the hypotenuse of the triangle-shaped rail forming the accessory attachment edge of the rail. The key 7 on the stabilizing recoil lug 10 can be made to fit any MOA rail. Existing rails can also be retrofitted to fit the key 7 by drilling, routing, or machining a pocket in the existing rail to receive the key.

In additional embodiments, the key 7 can be pinned to the receiver 11 using holes drilled through the rail 12 that correspond to holes drilled in the key 7. In other embodiments, the rail can be welded, fused, soldered, or attached using Loctite or an adhesive to the key 7 on the stabilizing recoil lug 10.

Using the device to stabilize a scope 16 and hold it in tandem to the rifle's barrel 17 can be accomplished in a number of steps. The method for maintaining the calibration of a rifle scope 16 on a rifle 1 comprises the following steps: positioning a lug 10 on a threaded end of a barrel 17 between the barrel 17 and an action receiver 11, the lug 10 having a top, a key 7 and an inner diameter, the inner diameter of the lug 10 being about equal to an external diameter of the threaded end of the barrel 17, and the action receiver 11 having a dorsal surface, the key 7 extending from the top of the lug 10 above the dorsal surface of the action receiver 11, and fastening a rail 12 to the dorsal surface of the action receiver 11 using fasteners, the rail 12 having a top and a bottom, and a pocket 8 located in the bottom of the rail 12. The key 7 fits the pocket 8 of the rail 12 when the rail 12 is fastened to the action receiver 11 and connects the rail 12 to the barrel 17. In one embodiment of the method, the lug 10 further comprises a key 7 having a top and the rail 12 further comprising a pocket 8 having a ceiling, the key 7 being shorter than the pocket 8, such that when the key 7 is in the pocket 8 there is a gap between the between the top of the key 7 and the ceiling of the pocket 8. As shown in FIG. 3, when performing the method with in an embodiment of the key having a single continuous side, each side touches a wall of the pocket. In one embodiment of the method, the rail 12 further comprises a pocket 8 having at least three walls and the lug 10 having a key 7 with at least three sides. In one embodiment, the key 7 has a single, continuous side that forms a circle, oval or other curved shape (i.e., a rounded rectangle, stadium, etc.) around the circumference of the key 7. When the key 7 is in the pocket 8, each one of the at least three sides of the key 7 touches at least one of walls of the pocket 8. In one embodiment of the method, there is an additional step of permanently attaching the key 7 of the lug 10 to the pocket 8 of the rail 12. In one embodiment of the method, the lug 10 further comprises a pinhole 10*a*, the pinhole 10*a* corresponding to a pinhole 11*a* of about the same size on an action receiver 11, and the method further comprising the step of pinning the lug 10 to the action receiver 11 by inserting a pin through both the pinhole 10*a* on the lug and the pinhole 11*a* on the action receiver. In one embodiment of the method, the sides of the key 7 fit the walls of the pocket 8 with an interference fit.

In one embodiment of the method, a rail can be retrofitted by cutting or machining a pocket from the bottom of the rail, the pocket corresponding to the shape of the key on a lug of the present disclosure. By retrofitting and existing rail, a rail may simply be upgraded to include a pocket through minimal machining so that it will mate with the key of a recoil lug of the present disclosure, so that the retrofitted rail can be used together with the lug of the present disclosure to stabilize the scope of a rifle.

FIGS. 8-24 show alternative views of one embodiment of the device described from multiple angles.

In one embodiment, the key has a front and a back side and the pocket has a matching front and back side so that the rail moves in tandem forward and backward with the lug along a horizontal plane. By contrast, such an embodiment would not necessarily be restricted from side to side or lateral movement like the other embodiments above, but would still restrict the rail from any forward or back ward movement in tandem with the lug and action receiver during recoil.

In one embodiment (not shown), the pocket extends up through the rail forming a hole that passes through the rail. This allows the protrusion on the lug to extend all the way through the rail. In such an embodiment, the protrusion can be outfitted with a hole and a pin or a screw so that the lug can be pinned or screwed to the rail. In such an embodiment, care is taken to keep the protrusion on the lug from interfering with a scope mounted on the rail.

In the foregoing description, it will be readily appreciated by those skilled in the art that modifications may be made to the invention without departing from the concepts disclosed herein. Such modifications are to be considered as included in the following claims, unless the claims by their language expressly state otherwise.

What is claimed is:

1. A recoil device for a rifle comprising:

a lug configured to sit in line between a barrel and an action receiver, said lug having a top, the action receiver having a dorsal surface, and the top of the lug comprising a key; and a rail configured to attach to the dorsal surface of the action receiver, the rail having a bottom, and the bottom of the rail comprising a keyseat to receive the key;

wherein, when the key mates with the keyseat, the key holds the rail in tandem with the lug and restricts its movement in a forward and backward direction relative to the barrel's direction of firing.

2. The device of claim 1, the key having a top, the keyseat having a ceiling, and the key being shorter than the keyseat, such that when the key is in the keyseat there is a gap between the top of the key and the ceiling of the keyseat.

3. The device of claim 1, the keyseat having a geometric shape and the key having a matching geometric shape, wherein when the key is in the keyseat, each one of the sides of the key touches at least one of the walls of the keyseat.

4. The device of claim 3, wherein the key is permanently attached to the keyseat.

5. The device of claim 1, the keyseat having a stadium shaped wall and a key having a corresponding shape, such that the key fits the keyseat with an interference fit, so that if the action receiver moves in any horizontal direction the rail moves with it.

6. The device of claim 1, further wherein when the key mates with the keyseat, the key and keyseat reinforce the connection reinforce the connection between the rail and the action receiver against rearward shear forces during recoil.

7. A device for a rifle comprising: a washer and a picatinny rail, the washer configured to sit between a barrel and an action receiver, said washer having a protrusion on at least one side;

the rail having a bottom, the protrusion configured to fit into a pocket in the bottom of the rail;

wherein, when the protrusion mates with the pocket, the protrusion holds the rail in tandem with the washer in a forward and rearward direction relative to the barrel's direction of firing.

8. The device of claim 7, the pocket further comprising a stadium shaped wall and the protrusion having a matching shape, wherein the circumference of the protrusion fits the circumference of the wall in an interference fit, restricting independent movement along a horizontal plane.

9. The device of claim 7, the pocket further comprising at least one wall forming a geometric shape and the at least one wall of the protrusion having a matching geometric shape, wherein the entire geometric shape of the wall fits the entire geometric shape of the side of the protrusion in an interference fit.

10. A rail for attaching a scope to a rifle comprising:

a rail, having a bottom, the bottom of the rail further comprising a keyseat having a geometric shape configured to receive a matching key of a recoil lug, wherein when the recoil lug having a matching key is positioned between an action receiver and a barrel, with the key positioned above a dorsal surface of the action receiver and the rail is seated on an action receiver, the key is inserted in the keyseat, and the key restricts movement of the rail in every horizontal direction relative to the key, the barrel, and the action receiver.

11. The device of claim 10, the rail further comprising two ends, and the keyseat is located off center toward one end of the rail.

12. The device of claim 10, wherein the key restricts movement of the rail by pinning the rail to the recoil lug.

13. The device of claim 10, wherein the keyseat passes all the way through the rail forming a hole in the rail, and the key extends through the top of the rail when the key is inserted in the keyseat.

14. A method for maintaining the calibration of a rifle scope on a rifle comprising:

positioning a lug on a threaded end of a barrel between the barrel and an action receiver, the lug configured to sit in line between a barrel and an action receiver, said lug having a top, the action receiver having a dorsal surface, and the top of the lug comprising a key; and fastening a rail to the dorsal surface of the action receiver using fasteners, the rail having a top and a bottom, and a pocket located in the bottom of the rail to receive the key, wherein the key mates with the pocket of the rail when the rail is fastened to the action receiver thereby connecting the rail to the barrel by holding the rail in tandem with the lug and restricting the rail's movement in a forward and backward direction relative to the barrel's direction of firing.

15. The method of claim 14, further wherein every side of the key fits every wall of the pocket with an interference fit.

* * * * *